United States Patent [19]

Doussiet et al.

[11] Patent Number: 5,024,110

[45] Date of Patent: Jun. 18, 1991

[54] CELL FOR SAMPLING AND STORING FLUID DEPOSITS

[75] Inventors: Roger Doussiet, Lezat S/Leze; Louis Labadie, Montrejeau, both of France

[73] Assignee: Societe Nationale Elf Aquitaine (Production), Courbevoie, France

[21] Appl. No.: 462,034

[22] Filed: Jan. 8, 1990

[30] Foreign Application Priority Data

Jan. 10, 1989 [FR] France ..... 88 00219

[51] Int. Cl.[5] ..... G01N 35/06

[52] U.S. Cl. ..... 73/864.62

[58] Field of Search ..... 73/864.13, 864.14, 864.51, 73/864.62, 864.63, 864.91

[56] References Cited

U.S. PATENT DOCUMENTS

| | | | |
|---|---|---|---|
| 1,638,333 | 8/1927 | Groetken | 73/864.63 |
| 1,950,854 | 3/1934 | Lerch | 73/864.62 |
| 3,218,869 | 11/1965 | Fields et al. | 73/864.64 |
| 3,793,888 | 2/1974 | Rosenwald | 73/864.62 |
| 3,950,999 | 4/1976 | Edwards | 73/864.62 |
| 4,406,171 | 9/1983 | Ueberschaer | 73/864.62 |
| 4,409,850 | 10/1983 | Zeck . | |
| 4,459,865 | 7/1984 | Welker . | |
| 4,463,804 | 8/1984 | Rooney et al. . | |
| 4,625,574 | 12/1986 | Robbins | 73/864.63 |

*Primary Examiner*—Robert Raevis

*Attorney, Agent, or Firm*—Oblon, Spivak, McClelland, Maier & Neustadt

[57] ABSTRACT

The rear face of the piston (7) and the corresponding inner face of the pump body (1,2,3,4) are complementarily shaped so as to make the volume of the rear chamber (31) of the cell as small as possible, and, when the cell is in the storing position, the unit of the two front (32) and rear (31) chambers is insulated from the outside by a high-efficiency seal (3*a*,6*a*) which is formed automatically when the piston (7) arrives in the storing position.

Measurements of the thermodynamic characteristics of the fluid deposits.

11 Claims, 4 Drawing Sheets

CELL FOR SAMPLING AND STORING FLUID DEPOSITS

BACKGROUND OF THE INVENTION

The present invention relates to a cell for sampling and storing fluid deposits.

These cells are closed receptacles with a calibrated volume in which are collected bottom samples of a pressurized fluid deposit or oil samples taken at the surface from the separator.

Such transfers of oil deposits are currently carried out in bottom sampling or in surface sampling using a mercury cell. After attaching a cell of this type, filled with mercury, onto the bottom sampling cell or onto the separator itself, the pressurized oil deposit is admitted into the mercury cell and a corresponding quantity of mercury is removed as it fills up.

Mercury is selected amongst all liquids because of its well-known intrinsic qualities of not polluting the transferred sample.

A technique of this type, widely known in the prior art and much employed, has disadvantages which are also caused by the nature of mercury. Firstly, mercury is a weighty product which makes the transfer operations heavier. Secondly, mercury is a dangerous product and highly toxic to such an extent that its use on a platform for the above application is forbidden by the terms of national statutory provisions such as, by way of example, the Norwegian regulations. In addition, if the sampled oil contains acid gases, $H_2S$ for example, there are risks of a reaction which may considerably falsify the measurements of the sample, which measurements are mainly termed PVT (pressure volume temperature) measurements, such as measurement of the bubble point, pressure at which the bubble appears, gas-oil mass ratio, measurement of the retraction of the oil under the influence of the loss of gas, etc.

SUMMARY OF THE INVENTION

The object of the present invention is to overcome the abovementioned disadvantages of mercury cells. It provides a simple device which can be handled easily, is reliable, can take samples at very high pressures (up to 700 bars) and does not contain any mercury.

In order to achieve this object, the sampling and storing cell comprises a pump body inside which a piston may be displaced, which piston establishes in this inner space a front chamber and a rear chamber. It is characterized by the fact that the complementarity of the shapes of the rear face of the piston and of the corresponding inner face of the rear chamber of the pump body make the volume of the said rear chamber very small when the piston is in the storing position, and in that, in this position, the unit formed by the said rear chamber and the front chamber is insulated from the outside by a high-efficiency seal which is formed automatically when the piston arrives in the said storing position. In the storing position, a means for locking the piston in translational movement is provided, which means is formed automatically when the piston arrives in the said storing position The complementarity of the shapes is achieved by a recess in the rear part of the piston, whose shape substantially complements the front part of an extension of the pump body.

In this manner, in the storing position, in other words in the extreme back position of the piston in the piston volume chamber the volume of the rear chamber is reduced to almost zero. Upon reaching this storing position, a metal/metal seal, in other words a high-performance seal, is automatically set up and insulates the two front and rear chambers from the outside.

In this manner, there is virtually zero risk of diffusion of the gas stored in the calibrated front chamber, the quantity of gas diffusing being limited by the volume, virtually zero, of the rear chamber which is perfectly insulated from the outside as a result of its automatic seal in the storing position.

Another advantage of the invention comes from the fact that the mechanical structure of the cell allows a reserve or buffer of gas to be provided with the sample taken, which is necessary in the event of a wide variation in the temperature of the storing or sampling area. The device, manual or automatic, for controlling the piston rod, and consequently the piston, has to this end means for reading the volume of the front chamber.

BRIEF DESCRIPTION OF THE DRAWINGS

Other advantages and features of the invention will emerge in the description below of a non-limiting embodiment of the subject of the invention, accompanied by the drawing in which.

DETAILED DESCRIPTION OF THE PREFERRED EMBODIMENTS

Figure 1:
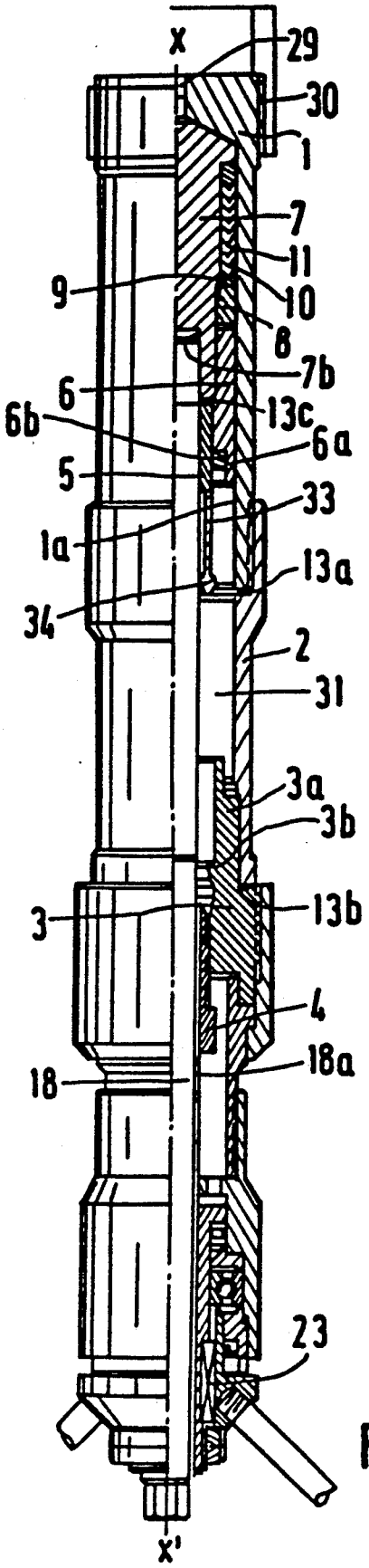
FIG. 1 is an axial view of the cell at a position when the sample of fluid deposit has begun to be admitted into the cell.

The sampling and storing cell chiefly comprises a pump body with several components 1,2,3,4 which will be described in detail hereinafter, a piston 7 which is displaced in a cylindrical chamber or piston volume of the pump body, and a mechanism for controlling the piston.

The pump body, whose general shape is substantially cylindrical about axis xx', is formed from several cylindrical pieces A cylinder 1, the cylindrical inner wall of which la forms a chamber for the displacement of a piston 7, has a threaded orifice 29 for admitting the fluid deposit, this orifice enabling connection to a duct which may be joined to the oil-gas separator at the surface of a production site. The screwthread 30 enables a protective cap to be screwed on. A cylinder-holding sleeve 2 is mounted by screwthread assembly as an axial elongation of the cylinder 1. A metallo-plastic seal 13*a*, ensuring perfect tightness between the two pieces when they are screwed onto each other with force, is laid between the cylinder 1 and the cylinder-holding sleeve 2. The pump body is then extended by a head 3 (FIGS. 1 and 1*b*) assembled by an outer screwthread on a bore in the cylinder-holding sleeve 2, the assembly likewise being provided with an intermediate metallo-plastic seal 13*b*. This head 3 has a cylindrical extension 3*a* which engages in the cylindrical chamber 31, termed the chamber to the rear of the piston 7. The head 3 has an inner bore in several sections with varying shapes and cross-sections which will be described later in detail.

Finally, the head 3 is elongated and closed by a cylindrical piece 4, which will be termed a lock, mounted by means of a screwthread on the rear section of the bore in the head 3, abutting against a shoulder 3*b* of the head 3. The bore for the lock 4 forms a guide bearing for the control rod of the piston 7 which is capable of translational movement in this lock 4.

The pump body formed in this way from the four elements: cylinder 1, cylinder-holding sleeve 2, head 3 and lock 4, forms on the inside a chamber or piston volume in which the piston 7, elongated by its control rod 18 traversing the bearing formed by the lock 4, can move translationally. In its displacement, the piston establishes two internal chambers of variable volume: a front chamber 32 (FIGS. 2 and 2*a*) defined by the inner bore of the cylinder 1 between the front face 7*a* of the piston 7 and the front part of the cylinder 1 on the admission side, and a rear chamber 31 defined by the inner bore of the pump body 1,2,3,4 and the rear face 7*b* of the piston 7.

The piston 7 comprises a sealing unit mounted annularly and set back from the head of the piston with piston packings 11 which grip rings 10, for example made of Teflon, the unit being held in place by a bearing washer 9 under the pressure of a nut which clamps the packing 8.

Also mounted on the body of the piston 7, as an elongation of the sealing unit, a tubular connector 6 is provided, the outer diameter of which is very close to the diameter of the inner wall of the chamber 1*a* of the cylinder 1 and of the inner wall of the cylinder-holding sleeve which elongates the latter It has a rear extension 6*a* with a smaller thickness, therefore having a degree of radial elasticity. This extension itself establishes a recess 6*b* intended to receive the front part of the extension 3*a* of the head 3 in the storing position (piston fully back). The tubular connector 6 carries, via its inner threaded bore, a collar 5 (FIGS. 1 and 1*a*) which surrounds the control rod 18 and elongates the piston head to which it abutts via a seal 13*c*. The collar is elongated by a tubular metal seal 33 which is radially elastic and terminates at its rear part in a flange 34 with a perfectly defined shape whose function will be described later. The tubular seal 33 may advantageously consist of a series of cylindrically arranged plugs.

The piston 7 is connected to its control rod 18 by a screwthread assembly in a bore 7*b* in the rear part of the piston body.

The shape and arrangement of the rear part of the tubular connector 6, the shape and arrangement of the collar 5 and of the tubular seal 33, as well as those of its flange 34 are designed and produced so as to fit, by their complementary shapes, in the front part or extension 3*a* of the head 3 and in the bore of the said head 3.

Figure 2:
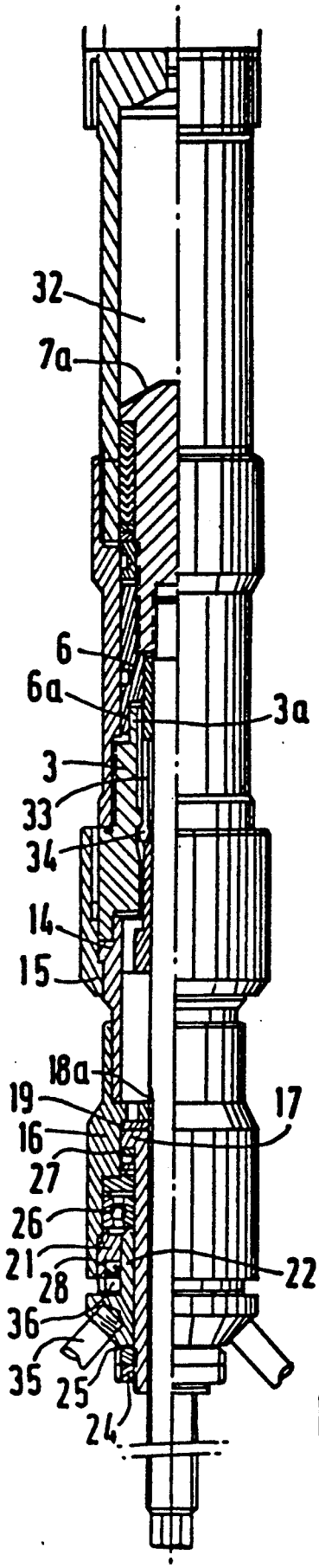
FIG. 2 is an axial view of the same cell in the position for storing the sample, the sample of fluid deposits having already been taken.
Figure 1B:
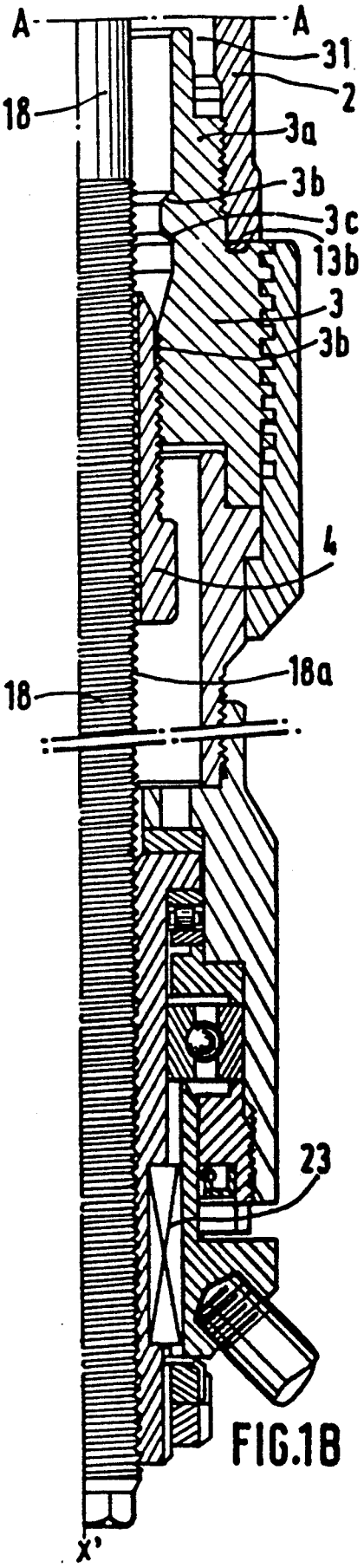
Figure 2A:
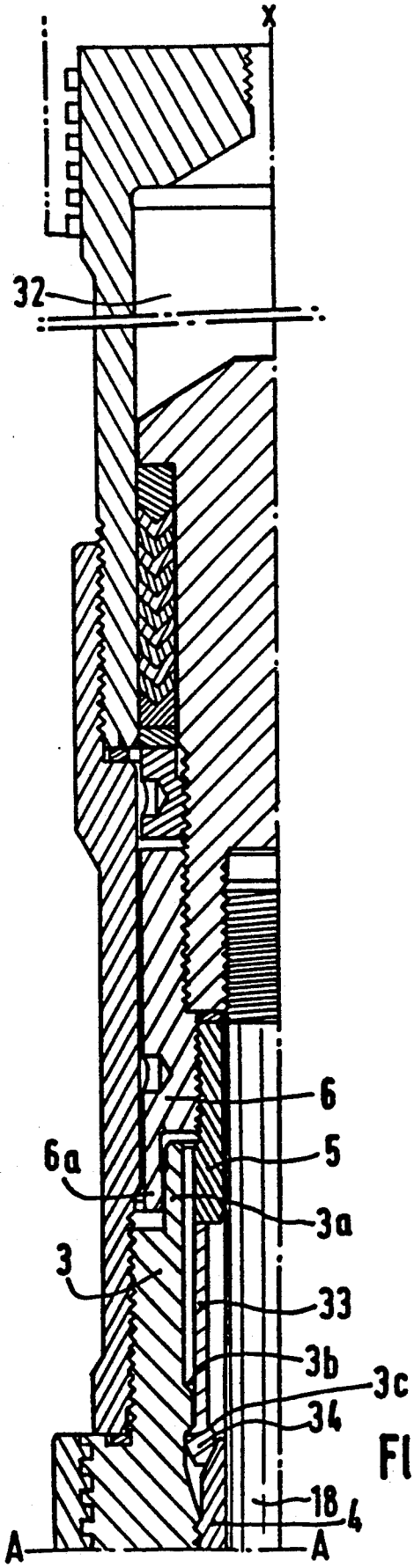
FIG. 2*a* and 2*b* are enlarged axial half-views of the cell in .the position shown in the drawing in FIG. 2.

This complementarity of shapes is illustrated by the drawing in FIGS. 2 and 2*a* showing the piston drawn fully back, a position in which the corresponding shapes are applied against each other, allowing the least possible amount of play between them. The extension 6*a* fits by slight radial deformation over the outer surface of the extension 3*a* of the head 3, whereas the flange 34, after radial contraction when it slides over the section 3*b* of the internal bore of the head 3, is locked against the section 3*c* of the same bore (FIG. 1*b* and 2*a*). Passage of the bearing flange 34 is made possible by the shape of the radially elastic tubular seal.

With the piston thus drawn fully back, the flange 34 also bears against the lock 4. The positioning of the flange 34 in the throat 3*c* produces an efficient locking of the piston 7 in translational movement.

Figure 3:
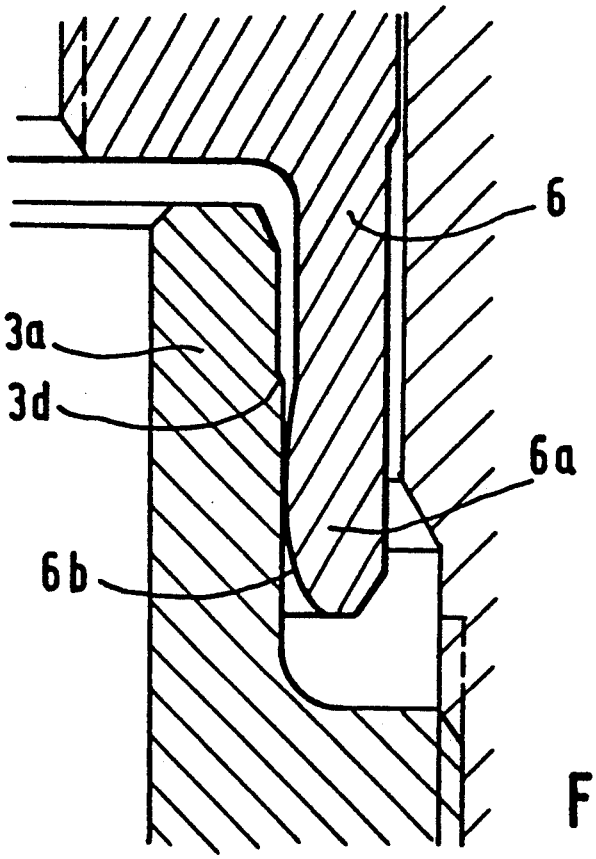
FIG. 3 is a detailed illustration of the configuration of the seal which, in the position for storing the sample, insulates the two chambers from the outside.

The complementarity of the shapes of the extension 6*a* to the extension 3*a* of the head is illustrated in the drawing in FIG. 3. The extension 6*a* has a swelling or concavity 6*b* and the extension 3*a* an incline 3*d* which gives a larger diameter to the extension 3*a* beyond the incline When the extension 6*a* is engaged on the extension 3*a*, locking takes place by the radial elastic reaction of 6*a* counter to the increase in diameter of 3*a*, beyond the incline 3*d*. This produces an effective seal. In order to slide better, the swelling 6*b* may be coated with PTFE (or Teflon) for example.

Figure 2B:
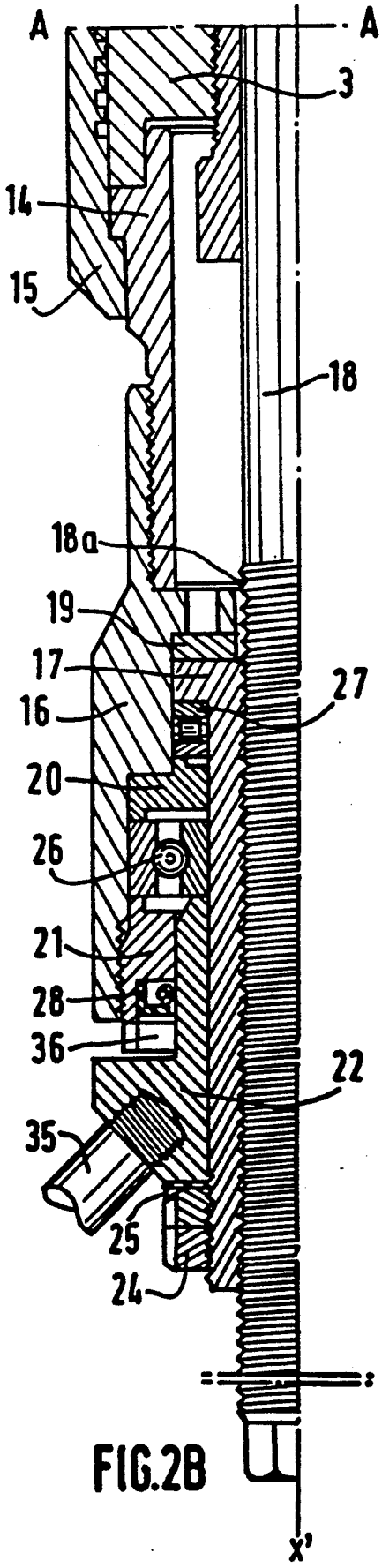

The control rod 18, which traverses the bearing formed by the lock 4, may be controlled in translational movement in both directions by means of a control device, stationary in translational movement, which may be described briefly as follows with reference to FIGS. 2 and 2*b*.

It has a substantially cylindrical housing 16 in which a control hub 22 is mounted, capable of being rotated by a lever 35 and which interacts with the screwthread 18*a* of the control rod 18, rotation of the hub 22 driving the control rod 18 in translational movement.

In order to effect this transformation of the rotational movement into translational movement, the hub 22 is connected to the stationary housing 16 by a rolling bearing-carrying nut 17 in which a thrust ball bearing 27 is housed, a spacing sleeve 20 between the stationary stop of the said thrust ball bearing 27 and the stationary outer housing of a rolling bearing 26 and a seal-carrying ring-nut 21 which grips a seal 28, the unit being closed by a cover 36. The hub 22 is integral in rotation with the roller bearing-carrying nut 17 via the key 23 (FIG. 1*b*). The inner bore of the nut 17 is threaded in order to interact with the screwthread of the control rod 18. The hub 22 is immobilized in translational movement between a means for connection to the pump body and a nut 24 clamped by a spring washer 25.

The roller bearing-carrying nut 17 is applied against a bearing washer 19 in the housing 16.

The whole of the control device is connected to the pump body; to this end, the housing 16 is assembled by means of a screwthread onto a joining body 14 which is brought into abutment against the head 3 of the pump body and clamped against the latter by a joining nut 15.

The connecting device thus described enables the control device to be mounted and removed easily; to do so, one need only take off the joining nut 15 in order to disassemble the pump body and the control device. The pump body after sampling forms an element which may be easily stored, whereas the control device may be usefully employed for taking other samples on other pump bodies.

Figure 1A:
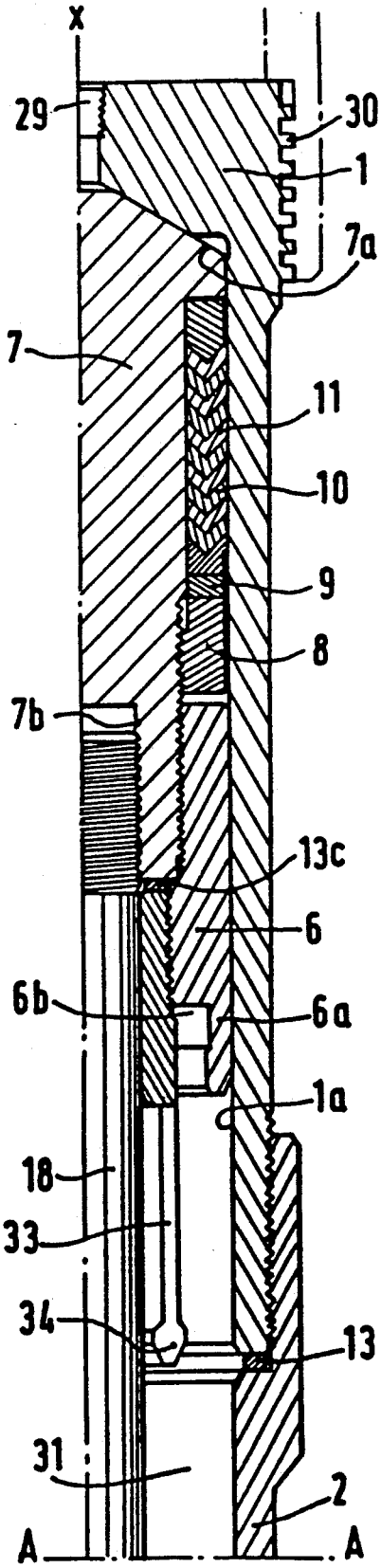
FIGS. 1*a* and 1*b* are enlarged axial half-views of the cell in the position shown in the drawing in FIG. 1.

The operation of the storing and sampling cell is as follows:

With the piston in the front position shown in the drawing in FIGS. 1, 1*a* and 1*b*, the cell is connected to a bottom sampling cell or to the oil-gas separator in the case of surface sampling. The fluid enters into the chamber via the admission orifice 29. Filling, and the creation of a gas buffer, take place by the displacement of the piston in the calibrated chamber as far back as it will go against the rear part of the pump body. In this position, the shape and arrangement of the corresponding components of the piston and of the pump body produce on the one hand efficient locking in translational movement of the piston by the action of the flange 34 of the tubular seal 33 in the throat 3c and, on the other hand, perfect metal/metal sealing by the engagement of the extension 6a of the tubular connector 6 onto the extension 3a of the head 3. In this position (FIGS. 2, 2a and 2b), it can be seen that the volume of the rear chamber 31 is reduced to virtually zero by the complementarity of the shapes.

In addition, this space, however small, is insulated from the outside by a metal/metal seal (6a, 3a) with a very high degree of efficiency. Consequently, the adaptation of the various components of the pump body and of the various components of the piston makes the quantity of substance which can diffuse from the front chamber 32 enclosing the sample negligible. In this way, the fluid does not lose any gas and the practical measurements on the sample are not falsified.

The front chamber 32 is separated from the rear chamber 31 by the sealing of the piston, namely by the sealing element 8 to 11. This sealing alone cannot be a complete barrier against the diffusion of gas from one chamber to another. This is why the structure and the shape of the mechanisms of the present invention, by reducing the volume of the rear chamber to virtually zero, virtually cancel out risks of diffusion.

We claim:

1. Cell for sampling and storing fluid deposits, comprising:

a pump body having a displaceable piston which divides an inner space of the pump body into a front chamber and a rear chamber; and a control device for displacing the piston via a rod integral with the piston;

wherein the complementarity of the shapes of a rear face of the piston and of a corresponding inner face of the pump body make a volume of the rear chamber very small as compared to a volume of the rear chamber when the piston is in a storing position;

wherein, in the storing position, a unit formed by the rear chamber and the front chamber is insulated from an exterior of the cell by a seal formed automatically when the piston arrives at the storing position during sampling;

wherein the complementarity of the shapes of the rear face of the piston and the inner face of the pump body includes a recess in a rear part of the piston, the recess having a shape which substantially complements a front part of an extension of the pump body, the front part of the extension engaging the recess in the rear part of the piston at the storing position; and wherein a cylindrical part of the piston forming a portion of the recess in the rear part of the piston is force-fitted by its radial elasticity onto an outer part of the extension of the pump body, to form the seal which insulates the unit of the front and rear chambers from the exterior of the cell.

2. Sampling and storing cell according to claim 1, wherein, in addition, in the storing position, a locking means for locking the piston in translational movement by complementarity of shapes is provided, the locking means being formed automatically when the piston (7) arrives in the storing position.

3. Sampling and storing cell according to claim 1, wherein the extension of the pump body and the cylindrical part of the piston are made from metal so as to obtain a metal/metal seal.

4. Sampling and storing cell according to claim 1, wherein the cylindrical part of the piston has, at an engaging section thereof, a swelling in order to increase a radial elastic return of the cylindrical part when the cylindrical part of the piston is engaged on the extension of the pump body.

5. Sampling and storing cell according to claim 1 or claim 4, wherein the front part of the extension of the pump body which engages into the cylindrical part of the piston has two sections comprising: an engaging section and a section with a diameter larger than a diameter of the engaging section which includes an elongation of the engaging section in order to increase a radial elastic return force when the cylindrical part and the extension interact by engagement at the storing position.

6. Sampling and storing cell according to claim 1, wherein the recess is carried by a tubular connector integral with the piston.

7. Sampling and storing cell according to claim 1, wherein the extension of the pump body is an extension of a constituent part comprising a head of the pump body.

8. Cell for sampling and storing fluid deposits, comprising:

a pump body having a displaceable piston which divides an inner space of the pump body into a front chamber and a rear chamber; and a control device for displacing the piston via a rod integral with the piston;

wherein the complementarity of the shapes of a rear face of the piston and of a corresponding inner face of the pump body make a volume of the rear chamber very small as compared to a volume of the front chamber when the piston is in a storing position;

wherein, in the storing position, a unit is formed by the rear chamber and the front chamber is insulated from an exterior of the cell by a seal formed automatically when the piston arrives at the storing position during sampling;

wherein the complementarity of the shapes of the rear face of the piston and the inner face of the pump body includes a recess in a rear part of the piston, the recess having a shape which substantially complements a front part of an extension of the pump body, the front part of the extension engaging the recess in the rear part of the piston at the storing position; and wherein locking means for locking the piston in translational movement includes a series of cylindrically arranged plugs which are radially elastic and have an end flange which engages a throat of the extension so as to lock the piston in translational movement.

9. Sampling and storing cell according to claim 8, wherein the plugs are carried by a collar integral with the piston.

10. Sampling and storing cell according to claim 8, wherein a stop at a front face of the locking means is provided at an inner rear part of the pump body.

11. Sampling and storing cell according to claim 8, wherein an incline (3b) for compressing the plugs radially before the plugs engage and disengage radially in the throat is provided on an rear inner bore of the throat, upstream from the latter in the direction of assembly.

* * * * *